United States Patent [19]

Marshall

[11] 4,383,349

[45] May 17, 1983

[54] OPENING BONDED GLASS FIBER BUNDLES

[75] Inventor: Preston F. Marshall, Walpole, Mass.

[73] Assignee: The Kendall Company, Walpole, Mass.

[21] Appl. No.: 175,337

[22] Filed: Aug. 4, 1980

[51] Int. Cl.[3] ..... B29J 5/00; B29C 13/00

[52] U.S. Cl. ..... 19/0.56; 19/0.6; 19/304; 19/305; 425/83.1

[58] Field of Search ..... 28/271, 273, 282, 283; 83/913; 156/344, 584; 210/509; 264/157; 19/0.3, 0.56, 0.58, 0.6, 304, 305, 306, 307

[56] References Cited

U.S. PATENT DOCUMENTS

| | | | |
|---|---|---|---|
| 1,938,982 | 12/1933 | Smith | 210/509 X |
| 2,909,827 | 10/1959 | Waugh | 19/305 X |
| 3,177,275 | 4/1965 | Brenner | 19/305 X |
| 3,187,387 | 6/1965 | Schuller | 19/305 |
| 3,479,707 | 11/1969 | Loueland | 28/273 |
| 3,545,057 | 12/1970 | Lubach | 28/273 |
| 3,694,862 | 10/1972 | Okuda et al. | 19/0.58 |
| 3,727,270 | 4/1973 | Marshall | 19/304 |
| 3,751,767 | 8/1973 | Marshall | 19/0.58 |
| 3,793,679 | 2/1974 | Marshall | 19/304 |
| 4,070,730 | 1/1978 | Pfeifer et al. | 19/0.58 |
| 4,140,450 | 2/1979 | Pfeifer et al. | 19/305 X |
| 4,180,378 | 12/1979 | Mielke | 19/304 X |
| 4,186,463 | 2/1980 | Marshall | 19/304 |

*Primary Examiner*—Louis Rimrodt

[57] ABSTRACT

Textile length multifilament bundles of coated and bonded glass fibers are fed into the fiber inlet of a momentum exchange aspirator having a high pressure propelling air source inlet providing propelling air at a velocity generally equal to the velocity of sound to cause flow of air to carry the bundles into the aspirator fiber inlet and produce a turbulent flow zone which destroys the interfiber bonds, without destroying the protective coating on the fibers and with minimum fiber breakage, to form a high velocity stream of discretely separated textile length coated glass fibers at the aspirator outlet.

11 Claims, 3 Drawing Figures

OPENING BONDED GLASS FIBER BUNDLES

This invention relates to the opening of textile length multifilament bundles of coated and bonded glass fibers and forming them into a high velocity gas carried stream of discretely separated textile length coated glass fibers.

Glass fibers of textile length are widely used in the manufacture of high quality non-woven webs used for a variety of purposes. The glass fibers for such webs are commercially produced in the form of a continuous multifilament strand usually consisting of several hundred to several thousand substantially parallel continuous glass fibers which are coated and bonded together with an interfiber bonding agent, such as starch, in order to protect the fibers from breakage and to facilitate handling of the strand. After cutting the continuous strand to the desired textile fiber length by a glass fiber strand cutter, it is necessary to separate the bonded fibers of the resulting multifilament bundles before forming them into a non-woven web. This has commonly been accomplished by either wet or dry web-forming processes which separate small groups of fibers and assemble them in the form of a fibrous web.

However, because of the presence of the interfiber bond, the conventional web-forming processes mentioned above do not adequately separate the individual fibers from one another, but instead they pluck off small groups or clumps of fibers so that the resulting webs are not uniform and have a blotchy appearance. Furthermore, a fibrous web composed of fibrous clumps or aggregates does not develop the tensile strength it would have if the fibers were completely separated.

Accordingly, it is a major object of the present invention to provide a novel process for opening bonded textile length multifilament bundles of coated textile length fibers into discretely separated coated glass fibers.

It is another object of the invention to accomplish such separation with a minimum of fiber breakage in order to provide discretely separated coated glass fibers of substantial length.

In my U.S. Pat. No. 3,751,767, there is described a momentum exchange aspirator device and process for using it in which continuous unbonded multifilament textile strands of fibers other than glass were shattered in a cryogenic air stream of a velocity at least 1.5 times sonic velocity to produce short fibers of random length which were then assembled into a web. Unbonded multifilament glass fiber strands have also been broken into ramdom short lengths by an air stream and collected into a web, as described in U.S. Pat. No. 1,938,982, for example. However, in the manufacture of high quality non-woven glass fiber webs, it is desirable to utilize textile length glass fibers of substantial length, rather than of extremely short length which do not contribute to web integrity, so that such processes, including that of my said patent, are unsatisfactory for processing coated and bonded multifilament glass fiber strands or bundles.

My U.S. Pat. Nos. 3,727,270 and 3,793,679 also describe similar devices and their uses for drafting unbonded textile length staple fibers of materials other than glass.

I have now discovered that by utilizing the aspirator devices of my above mentioned patents under unique conditions, it is possible to separate the individual coated glass fibers of multifilament bundles by destroying the bonds therebetween, without destroying their essential protective coating and without substantial fiber breakage, to form a high velocity stream of discretely separated textile length coated glass fibers of substantial length which may thereafter be assembled to provide a highly uniform web.

This I have accomplished by feeding the bonded strand bundles of coated glass fibers into the aspirator fiber inlet and a pressurized propelling gas, usually air, into the aspirator propelling gas inlet of a momentum exchange aspirator to produce at the aspirator outlet a high velocity stream of discretely separated coated glass fibers. In order to destroy the interfiber bonds without destroying their protective coating and to minimize breaking the individual glass fibers, the pressure of the propelling gas is kept relatively low, a pressure of about 15 to 20 pounds per square inch (gauge) being satisfactory, to produce at the propelling gas inlet a velocity approximately equal to the velocity of sound at the temperature of the propelling gas, with the aspirated gas flow being of a volume of cubic feet per minute less than, preferably about one quarter to one half, that of the volume in cubic feet per minute of the high pressure propelling air. The velocity of the gas exiting from the momentum exchange aspirator is about one-fourth to one-half the velocity of sound in the medium.

Under these conditions, a turbulent flow zone is produced between the high velocity propelling gas and the aspirated gas. This zone uniquely functions to separate the individual textile length coated glass fibers of the multifilament bundles by destroying the interfiber bonds, but without destroying the protective coating on the individual fibers and with minimum breakage of the fibers, to form a high velocity stream of discretely separated textile length coated glass fibers of substantial length. Furthermore, since the process of this invention results in a gas-borne dispersion in which substantially all the coated fibers are separated from one another and are of substantial length, the resulting glass fiber webs display a uniformity of density and freedom from mottled or blotchy appearance which cannot be realized with conventional techniques for forming glass fiber webs.

In addition, the aspirated gas and the high pressure propelling gas should have a temperature substantially below the melting temperature of the glass fibers and below the failure temperature of the coating and bonding agent so as to avoid destroying the essential protective coating on the glass fibers, since if the protective coating is destroyed, the contact of the bare glass fibers with one another will cause the individual fibers to fracture into extremely short lengths containing a high proportion of glass fiber "dust", both of which are unsatisfactory for forming glass fiber webs.

For the purpose of fully describing my invention, reference is now made to the following detailed description of preferred embodiments thereof, together with the accompanying drawings, wherein.

Figure 1:
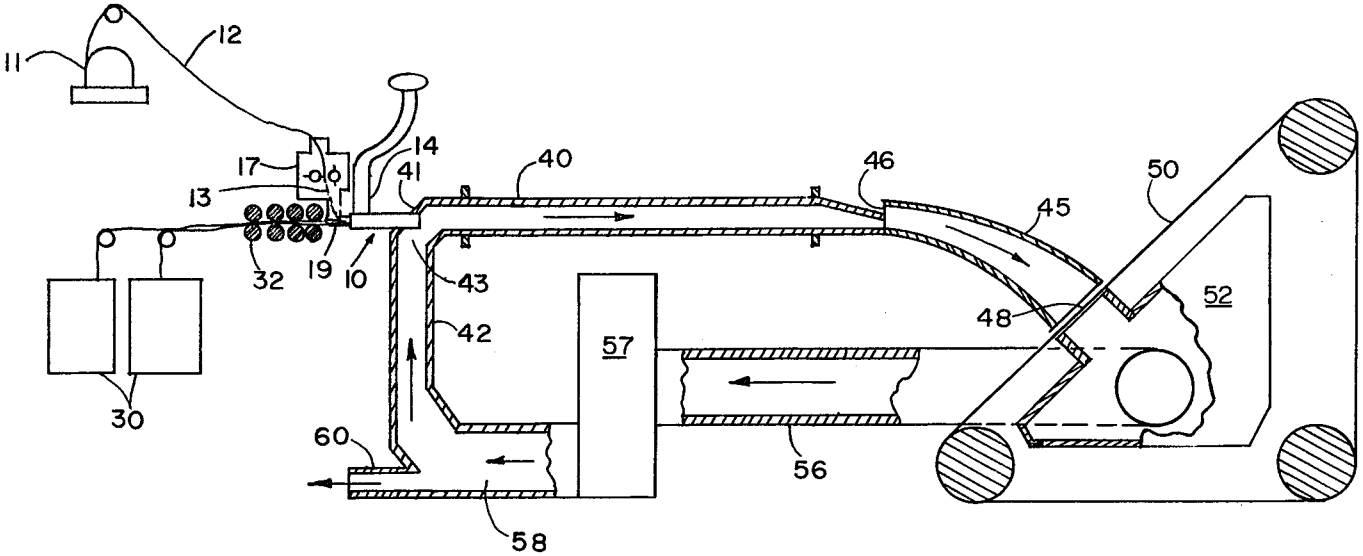
FIG. 1 is a diagrammatic side sectional view of apparatus suitable for carrying out the methods of my invention.

Referring to the drawings, one or more continuous multifilament glass fiber strands 12 of substantially parallelized glass fibers coated and bonded together with an interfiber bonding agent, such as starch, is fed from one or more supply spools 11 into the entrance end of one or more enclosed glass fiber strand cutters 17 and cut to the desired textile fiber length, which may be from as short as about 0.125 to about 2.00 inches or greater. The resulting bundles 13 (FIG. 3) are exposed to the action of air being aspirated through the entrance end of fiber strand cutters 17 into an enclosed strand cutter delivery tube 19 and thence into the fiber inlet end 18 of momentum exchange aspirator 10 (FIG. 3) to convey them through delivery tube 19 and into aspirator 10.

Figure 3:
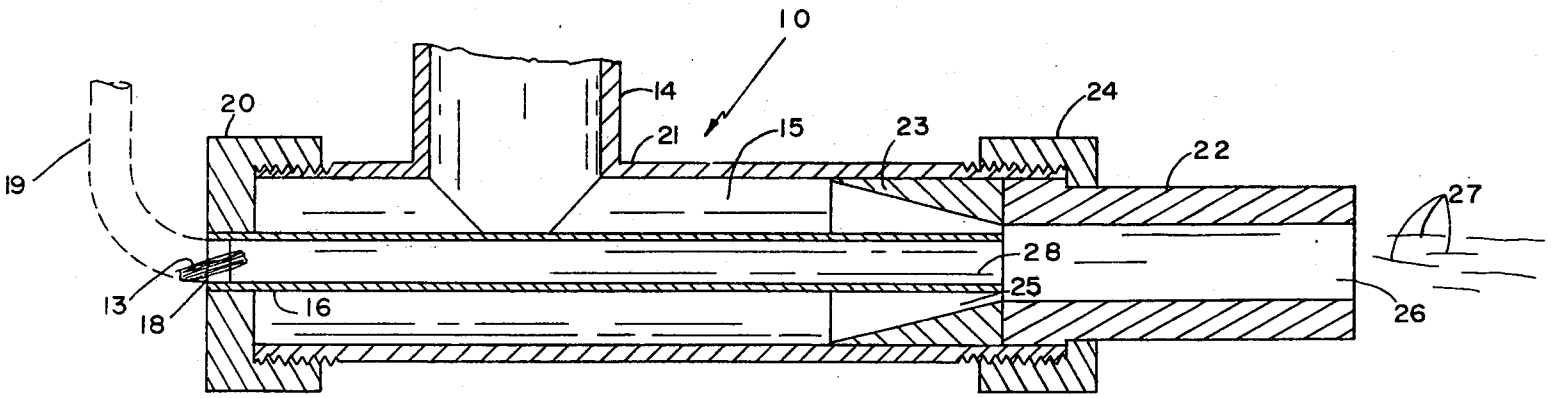
FIG. 3 is an enlarged side sectional view of the momentum exchange aspirator of the apparatus of FIGS. 1 and 2.

As best shown in FIG. 3, the aspirated air carrying bundles 13 passes through aspirator guide tube 16 and is subjected beyond its downstream end to a turbulent flow zone established between high velocity propelling air introduced through propelling air inlet 25 and the aspirated air carrying bundles 13 to form a high velocity stream 27 of discretely separated textile length coated glass fibers at the output end 26 of aspirator 10.

In general, aspirators suitable for the practice of this invention are similar to the jet nozzles described in my U.S. Pat. Nos. 3,727,270, 3,751,767, and 3,793,679, the differences in process lying in the novel parameters of air pressure and velocity employed in the present invention, as hereinafter explained in detail.

As seen in FIG. 3, in its basic form, aspirator 10 has a cylindrical chamber 15, with wall section 21, capped at one end by an inlet cap 20 containing a fiber inlet 18 which may be connected to strand cutter delivery tube 19 for the introduction of bonded glass fiber bundles 13 through aspirator guide tube 16, which is attached to cap 20. The other end of chamber 15 is capped by an exit cap 24, which restrains the straight exit section 22 and the nozzle section 23 of the device. Sections 22 and 23 are separate pieces, fitting in sliding relationship in chamber 15. In operation, they are held against lateral displacement toward guide tube 16 by the air pressure in chamber 15. The propelling air under pressure is fed to chamber 15 by means of air connection 14. The distance to which guide tube 16 projects past nozzle portion 23 of the device is adjustable by means of threaded cap 20.

In accordance with the present invention, in order to destroy the interfiber bonds without destroying their protective coating and to minimize breaking the individual glass fibers, the pressure of the propelling air is kept relatively low, a pressure of about 15 to 20 pounds per square inch (gauge) being satisfactory, to produce at propelling air section 25 a velocity approximately equal to the velocity of sound at the temperature of the propelling air. The propelling air creates a propagated vacuum which extends back through guide tube 16 and establishes a substantial flow of aspirated air at the input end 18 thereof and through strand cutter 17 and its delivery tube 19 which carries the bonded multifilament bundles 13 into aspirator guide tube 16. Since the strand cutter 17 is enclosed and located above aspirator inlet 18 and is connected to aspirator inlet by its enclosed downwardly extending delivery tube 19, the resulting air flow through the entrance end of enclosed strand cutter 17 prevents jamming or buildup of glass fibers in cutter 17.

The aspirated air flow should be of a volume in cubic feet per minute less than, preferably about one quarter to one half, that of the volume in cubic feet per minute of the high pressure propelling air. The propelling air stream diverges in the propelling air inlet section 25 to produce a turbulent zone which surrounds the aspirated air carrying bundles 13. This turbulent zone functions to separate the individual textile length coated glass fibers of multifilament bundles 13 by destroying the interfiber bonds, but without destroying the essential protective coating on the fibers to minimize breakage of the individual fibers, to form a high velocity stream of discretely separated textile length coated glass fibers 27 which are expelled through the nozzle orifice 26 in cap 24.

In order to decelerate the high velocity stream of fibers to a manageable velocity for collection on a collection screen, it has been found convenient to employ plenum apparatus into which a plurality of streams of separated coated glass or other fibers is exhausted. Accordingly, the apparatus shown in FIGS. 1 and 2 includes an array of fourteen momentum exchange aspirators 10, all of which are arranged to discharge their fiber streams into a single plenum apparatus for collection on a single collection screen conveyer belt 50.

More specifically, the array of fourteen momentum exchange aspirators 10 are horizontally arranged alternately in two sets, one set of six glass fiber aspirators 10G and another set of eight blend fiber aspirators 10B for adding blending fibers when and if desired.

As explained above, the glass fiber aspirators 10G are each fed by a continuous coated and bonded multifilament glass fiber strand 12 cut into bundles 13 of the desired length by means of glass fiber strand cutter 17 and fed through its delivery tube 19 to aspirator fiber inlet 18. The cut bundles 13 are exposed to the action of air being aspirated through strand cutter 17 and its deivery tube 19 into the fiber inlet end 18 of momentum exchange aspirator 10G to carry them into aspirator 10G. The aspirated air carrying bundles 13 passes through aspirator guide tube 16 and is subjected beyond its downstream end to a turbulent flow zone established between high velocity propelling air introduced through propelling air inlet 25 and the aspirated air carrying bundles 13 to form, at the output end 26 of aspirator 10G, a high velocity stream of discretely separated textile length coated glass fibers 27 which are diffused into the plenum apparatus.

If it is desired to blend other fibers with the glass fibers in order to produce a composite fiber web, such fibers may be introduced into each of blend fiber aspirators 10B. For example, a multifiber silver of staple textile length fibers of any desired blending fiber, either natural or manmade, of cellulosic or of organic plastic material, may be fed from silver cans 30 through the drafting rolls of draw frame 32 directly into aspirator fiber inlet 18 where it is exposed to the action of air being aspirated into the fiber inlet end 18 of momentum exchange aspirator 10B to carry it into aspirator 10B. The aspirated air carrying the silver passes through aspirator guide tube 16 and is subjected beyond its downstream end to a turbulent flow zone established between high velocity propelling air introduced through propelling air inlet 25 and the aspirated air to form a high velocity stream of discretely separated textile length staple fibers at the output end 26 of aspirator 10B, which stream is also diffused into the plenum portion of the apparatus.

Figure 2:
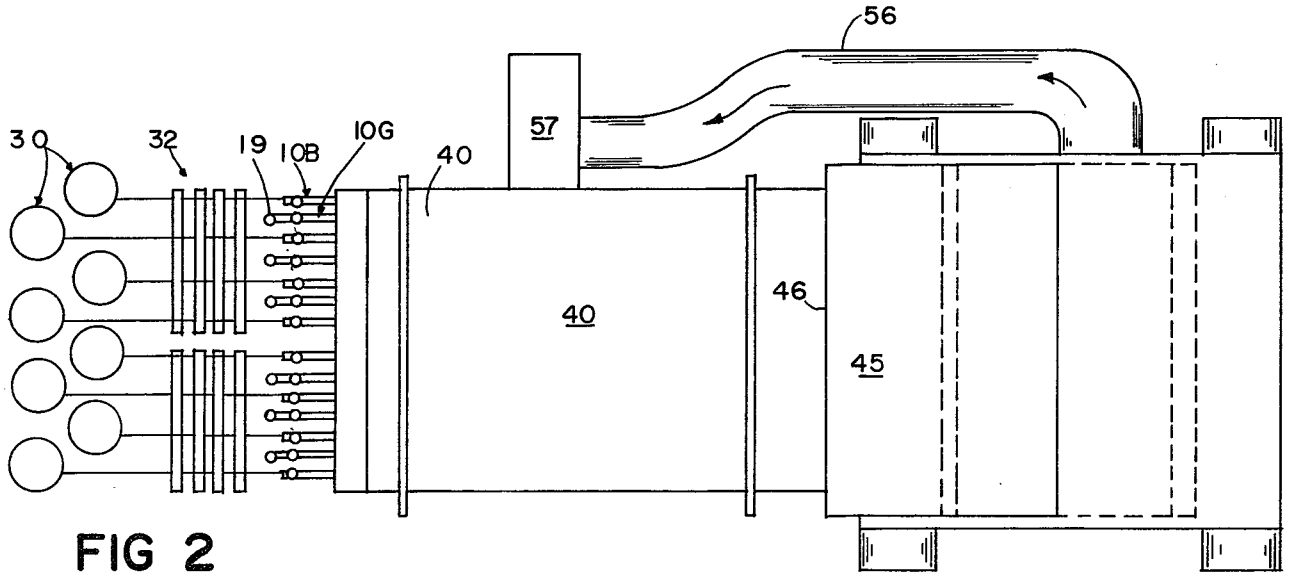
FIG. 2 is a diagrammatic top view, partly broken away to omit the glass fiber strand feeding and cutting elements of the apparatus of FIG. 1.

The plenum portion of the apparatus shown in FIGS. 1 and 2, into which the fibrous streams from the aspirators are discharged, has a longitudinally extending horizontal inlet chamber 40 having a fiber stream inlet opening 41 which extends transversely throughout the width of the array of momentum exchange aspirators 10 for receiving the stream of fibers from each of the aspirators. A vertically extending inlet air duct 42 having an inlet air opening 43 extending beneath fiber stream inlet opening 41 is provided for supplying a stream of conveying air to the inlet end of inlet chamber 40. A downwardly curved expansion chamber 45 of vertically increasing dimension is connected to the downstream end of inlet chamber 40, said expansion chamber having an ambient air inlet 46 extending across the upper portion of its inlet end for increasing the volume and reducing the velocity of the conveying air to provide a substantially uniform flow of fibers, at a manageable velocity, emerging from the exit of expansion chamber exit 45 to impinge on the upper surface of the collection screen conveyor belt 50. A vacuum box 52 is mounted on the under side of conveyor belt 50 at its exposed portion 48 to collect the conveying air and assure proper deposition of the fibrous web on exposed portion 48 of conveyor belt 50. The conveying air is then returned through duct 56, blower 57 and duct 58 to the inlet opening 41 of conveying air inlet chamber 40. Preferably, duct 58 is provided with an adjustable exhaust air outlet 60 so that both the rate of the recirculating conveying air flow and its temperature increase during recirculation may be controlled as desired.

In some cases, when the deposited web is to be subjected to subsequent treatment such as lamination with another substrate, it is convenient to interpose between the collection screen and the fibrous stream, a layer of permeable supportive material such as gauze, cellulose tissue, porous nonwoven fabric, or the like. Such expedients are well-known in the art, and are not shown.

The term "manageable velocity", as employed above, means a stream velocity at which the fibers can be deposited continuously onto a moving porous collection conveyer belt with substantial absence of fiber clumping or deflection of the stream. The purpose of the plenum apparatus, therefore, is to spread the high velocity stream over a large cross section, so that the kinetic energy of the stream is transferred to pressure, by diffusion. This pressure forces the air through the porous collection conveyor belt, which filters out the fibers and deposits them on the conveyor belt in the form of a fleece. A convenient range of exit velocity, that is, the air velocity at which the decelerated fibrous stream impinges on the porous collection conveyor belt, has been found to be from 3 to 300 feet per second.

Throttling the velocity of the fibrous stream issuing from the aspirator down to a manageable exit velocity is a function of the parameters of the plenum apparatus, which can be calculated from a consideration of the volume of air be handled.

The glass fibers which may be processed in accordance with the present invention are commercially produced in the form of a continuous multifilament, essentially untwisted strand of several hundred to several thousand substantially parallel continuous glass fibers which are coated and bonded together with an interfiber bonding agent, such as starch, both to bond them together to facilitate handling and to coat and so protect the individual glass fibers which are otherwise exceeding susceptible to breakage by interfiber contact.

A typical Owens Corning BETA multifilament strand including approximately 1224 continuous glass fibers coated and bonded together with starch weighs about 15,000 yards per pound. Other typical Owens Corning multifilament strands include approximately 50 to 2000 continuous glass fibers coated and bonded together with starch, which weigh between 1500 and 45,000 yards per pound. The processes of the present invention are useful, however, in a wider range of multifilament glass strands, including those having up to several thousand glass filaments, with fiber diameters ranging from 3.5 microns to 13 microns or higher.

For operation in accordance with the present invention, as stated above, in order to destroy the bonds between the individual fibers without destroying the essential protective coating on the individual glass fibers and without substantial breakage of the individual glass fibers, the pressure of the propelling air is kept relatively low, a pressure of about 15 to 20 pounds per square inch being satisfactory, to produce at the propelling air inlet 25 a velocity approximately equal to the velocity of sound at the temperature of the propelling air. Also, the amount of air aspirated into the aspirator should be generally limited to the amount of air needed to carry the bonded fiber bundles into the turbulent zone produced between the high velocity gas and the propelling air downstream from propelling air inlet 25. The velocity of the air exiting from aspirator 10 is about one-fourth to one-half of the velocity of sound in that medium.

In addition, as also stated above, the aspirated air and the high pressure propelling air should have a temperature substantially below the failure temperature of the coating and bonding agent, so that the coating on the individual fibers is retained in order to minimize fiber breakage, particularly as the fibers pass through the momentum exchange aspirator.

It is preferred that aspirator 10 be of a generally cylindrical construction, so that the column of aspirated air carrying the bonded fiber bundles is cylindrical and is surrounded by and hence coaxial with a hollow cylindrical cylinder of high flow velocity propelling air from circular propelling gas inlet 25.

It is believed that the separation of individual fibers from the bonded fibers bundles begins at the propelling air inlet 25, the beginning of the turbulent zone in the aspirator 10 at which there occurs a momentum exchange, which may also be described as mixing or inelastic impact, between the aspirated air and the propelling air.

Since the hollow column of high velocity propelling air surrounds the column of aspirated air, it is further believed that the turbulent mixing, creating the momentum exchange, first occurs at the outside of the coaxial column of aspirated air carrying the bonded fiber bundles and then moves inwardly toward the center of the aspirated air column as it moves downstream. This action apparently pulls the bonded fiber bundles alternately between the two air streams, so that the major portion of the individual fiber separation is accomplished by the recurrent passage of the bonded fiber bundles through the turbulent interface between the inner aspirated air column and the surrounding column of propelling air.

Under these conditions, the turbulent flow zone produced between the high velocity propelling gas and the aspirated gas uniquely functions to separate the individual textile length coated glass fibers of the multifilament bundles by destroying their interfiber bonds, with minimum breakage of the fibers and without destroying the protective coating on the individual glass fibers, to form a high velocity stream of discretely separated textile length coated glass fibers 27 of substantial length, resulting in an air-borne dispersion in which substantially all the fibers are separated from one another, which stream is expelled through nozzle orifice 26 into the plenum portion of the apparatus for collection on screen conveyor belt 50.

The invention will be illustrated by the following examples. In each case, an apparatus as shown in FIGS. 1 and 2 was used. Six continuous bonded multifilament glass fiber strands 12 were fed from supply spools 11, each to the entrance end of a strand cutter 17, through its delivery tube 19 and into the fiber inlet end 18 of aspirator tube 16 of an aspirator 10G at a rate controlled by the speed of strand cutter 17.

Fourteen identical aspirators 10, as shown in FIG. 3, were mounted as shown in FIGS. 1 and 2. The inside diameter of aspirator air inlet tube 16 was 0.380" and that of the propelling air inlet and the mixing area downstream to the aspirator output end 26 was 0.562 inches, providing a throat net area of 0.0517 square inches and an exit area of 0.2481 square inches.

In the plenum portion of the aparatus, input chamber 40 was 51 inches long, 40 inches wide and 4.5 inches deep, reducing to 3 inches deep at its outlet end adjacent ambient air inlet 46. Expansion chamber 45 was 35 inches long, 42 inches wide, 4 inches deep at its inlet end, providing an ambient air inlet 1 inch deep, and was 6 inches deep at its outlet end. The exposed area of the collection screen conveyor belt portion 48 and the cooperating opening of vacuum box 52 therebelow was 42 by 6 inches.

EXAMPLE I

The six aspirators 10G were used. The eight aspirators 10B were not used, but remained in position.

An air pressure of 20 pounds per square inch (gauge) was applied to the six aspirators 10G, producing, at each aspirator, a compressed air flow of 32.6 cubic feet per minute and an exit flow of about 47 cubic feet per minute at a velocity of about 30,000 ft/min. The flow at propelling gas inlet section 25 was at a velocity of approximately the speed of sound.

The six aspirators 10G were fed with an Owens Corning multifilament glass strand identified as electrical type glass, continuous filament having about 1632 filaments of about 6 microns filament diameter (DE), weighing 3,700 yards per pound, and coated and bonded with Owens Corning type 602 coating and bonding agent. The strand was fed by the strand cutters 17 at about 1,200 ft/minute. The strand cutter blades were spaced to cut fiber bundles about 1⅛ inches long. Collector screen conveyer belt 50 was run at a speed of 12 feet per minute.

A secondary source of blower air produced by blower 57 was employed to aid in conveying the individual fibers from the exit of the aspirators 10G through chambers 40 and 45 to the collection screen conveyer belt 50. This secondary air, propelled by blower 57 sucking air through collection screen conveyer 50 through vacuum box 52, provided an air flow of approximately 8,000 cubic feet per minute through the plenum portion of the apparatus. The air was channeled through a primary closed circuit, including chambers 40 and 45, vacuum box 52 and ducts 56, 58 and 42, with about one-eighth of the air (1000 cubic feet per minute) being exhausted through exhaust air outlet 60. Another 1000 cubic feet per minute of free air was drawn into the plenum portion of the apparatus through ambient air inlet 46, serving to smooth the air flow and also to reduce the temperature build up within the plenum portion of the apparatus so that the temperature rise of the recirculating air was held down to about 20° F. above the ambient temperature. The suction in vacuum box 52 under the 42 by 6 inch exposed collection screen area 48 was at a vacuum of about 9.5 inches of water.

The resulting 42 inch wide web had a weight of 53 grams per square yard and was an extremely even web, slightly compacted, well opened and with enough physical strength to be self sustaining through subsequent processing.

EXAMPLE II

Otherwise using the same configurations and speeds as in Example I, the speed of the collector screen conveyer belt 50 was varied to increase and decrease the final web weight. Webs of from 20 grams per square yard to 120 grams per square yard were produced.

EXAMPLE III

Otherwise using the same configuration and speeds as in Example I, in addition to using the set of six momentum exchange aspirators 10G for introducing glass fibers as in Example I, the set of eight aspirators 10B was used to introduce a 1.5 denier, 1 9/16 staple length, 60 grain per yard rayon fiber silver which was fed from the silver cans 30 to a four-over-four fluted roll draw frame 32 using a draft of ten. The front roll of draw frame 32 was arranged to be in close proximity to the inlet 18 of the aspirators 10B. The speed of the draw frame was adjusted so that the total output of silver matched that of the glass strand cutters. A uniform blended glass-rayon fiber web was produced.

I claim:

1. A method of forming a high velocity stream of discretely separated textile length coated glass fibers of substantial uniform length from substantially uniform length multifilament strand bundles of substantially parallel glass fibers coated and bonded together with an interfiber bonding agent, comprising feeding said bonded strand bundles into the aspirator fiber inlet of a momentum exchange aspirator having a high pressure propelling gas source inlet providing propelling gas at a velocity at said propelling gas inlet generally equal to the velocity of sound at the temperture of said propelling gas to cause flow of aspirated gas through said aspirator inlet at a volume in cubic feet per minute less than that of the volume in cubic feet per minute of said high pressure propelling gas to carry said bundles into said aspirator inlet and to produce a turbulent flow zone between said aspirated gas and said propelling gas for separating in said turbulent flow zone the individual textile length glass fibers of said multifilament bundles by destroying the interfiber bonds therebetween without destroying the protective coating on said fibers and with minimum breakage of said fibers to form said high velocity stream of discretely separated textile length coated glass fibers of substantial length.

2. A method of forming a high velocity stream of discretely separated textile length coated glass fibers of substantial uniform length from substantially uniform length multifilament strand bundles of substantially parallel glass fibers coated and bonded together with an interfiber bonding agent, comprising feeding said bonded strand bundles into the aspirator fiber inlet of a momentum exchange aspirator having a surrounding high pressure propelling gas source inlet providing propelling gas at a velocity at said propelling gas inlet generally equal to the velocity of sound at the temperature of said propelling gas to cause flow of aspirated gas through said aspirator fiber inlet at a volume in cubic feet per minute less than that of the volume in cubic feet per minute of said high pressure propelling gas within said surrounding high velocity propelling gas to carry said bundles into said aspirator fiber inlet and to produce a turbulent flow zone between said aspirated gas and said surrounding propelling gas for separating in said turbulent flow zone the individual textile length glass fibers of said multifilament bundles by destroying the interfiber bonds therebetween without destroying the protective coating on said fibers and with minimum breakage of said fibers to form said high velocity stream of discretely separated textile length coated glass fibers of substantial length.

3. A method as claimed in claim 2, wherein said flow of aspirated gas through said aspirator fiber inlet is at a volume in cubic feet per minute of about one-quarter to one-half that of the volume in cubic feet per minute of said high pressure propelling gas.

4. A method as claimed in claim 1, 2 or 3, wherein said propelling gas is provided at a pressure of between about 15 and 20 pounds per square inch (gauge).

5. A method as claimed in claim 1, 2 or 3, wherein said aspirated gas and said high pressure propelling gas have a temperature substantially below the melting temperature of said glass fibers and below the failure temperature of said coating and bonding agent.

6. A method as claimed in claim 1, 2 or 3, wherein said strand bundles are between about 0.1 to 2.0 inches long and contain up to several thousand coated glass filaments.

7. A method of forming a high velocity stream of discretely separated textile length coated glass fibers of substantial length from a continuous multifilament strand of substantially parallel continuous glass fibers which are coated and bonded together with an interfiber bonding agent, comprising cutting said strand into textile length multifilament strand bundles of substantially parallel glass fibers coated and bonded together with said interfiber bonding agent conveying said bonded cut strand bundles into a aspirator fiber inlet of a momentum exchange aspirator having a high pressure propelling gas source inlet providing propelling gas at a velocity at said propelling gas inlet generally equal to the velocity of sound at the temperature of said propelling gas to cause flow of aspirated gas through said aspirator fiber inlet at a volume in cubic feet per minute less than that of the volume in cubic feet per minute of said high pressure propelling gas to carry said bundles into said aspirator fiber inlet and to produce a turbulent flow zone between said aspirated gas and said propelling gas for separating in said turbulent flow zone the individual textile length glass fibers of said multifilament bundles by destroying the interfiber bonds therebetween without destroying the protective coating on said fibers and with minimum breakage of said fibers to form said high velocity stream of discretely separated textile length coated glass fibers of substantial length.

8. A method as claimed in claim 7, wherein said strand is initally fed into the entrance end of an enclosed strand cutting apparatus having an enclosed delivery tube, and said bonded cut strand bundles are conveyed through said delivery tube into said aspirator fiber inlet, whereby, said aspirated gas flows through said cutting apparatus from its entrance end, through said delivery tube and into said aspirator fiber inlet to prevent jamming or buildup of glass fibers in said strand cutting apparatus.

9. A method as claimed in claim 7 wherein the volumetric rate of flow of aspirated gas through said aspirator fiber inlet is between one-quarter and one-half that of said high pressure propelling gas.

10. A method for making a non-woven web of glass fibers from continuous multifilament glass strand wherein individual filaments are coated and bonded together comprising cutting said multifilament strand into multifilament stranded bundles of parallel filaments coated and bonded together, said bundles being of uniform predetermined length, conveying on an aspirator generated air stream said bundles into an aspirator fiber inlet of a momentum exchange aspirator, propelling gas at sonic velocity through a propelling gas inlet surrounding said fiber inlet in said asperator to induce a flow of aspirated gas through said fiber inlet which is less volumetrically than the flow of propelling gas and which conveys said bundles to said fiber inlet and further to produce turbulent flow between aspirated gas and propelling gas which separates individual fibers by breaking interfiber bonding while leaving fibers unbroken and fiber coating intact, reducing in an expansion chamber downstream from said aspirator the velocity of individual fibers so separated to a manageable velocity for being continuously deposited, impinging separated fibers on the surface of collecting means to form a web of uniformly dimensioned separated fibers.

11. A method as claimed in claim 10, wherein flow of aspirated gas through said fiber inlet is between one-quarter and one-half that of the flow of propelling gas around said inlet and said propelling gas is supplied at a pressure between 15 and 20 psig.

* * * * *